US012312825B1

(12) United States Patent
Powell

(10) Patent No.: US 12,312,825 B1
(45) Date of Patent: May 27, 2025

(54) TENT FRAME ASSEMBLY

(71) Applicant: Kinematic Sports, LLC, Pelham, AL (US)

(72) Inventor: Patrick Powell, Helena, AL (US)

(73) Assignee: Kinematic Sports, LLC, Pelham, AL (US)

( * ) Notice: Subject to any disclaimer, the term of this patent is extended or adjusted under 35 U.S.C. 154(b) by 114 days.

(21) Appl. No.: 18/122,059

(22) Filed: Mar. 15, 2023

(51) Int. Cl.
*E04H 15/38* (2006.01)
*E04H 15/48* (2006.01)

(52) U.S. Cl.
CPC ..... *E04H 15/38* (2013.01); *E04H 15/48* (2013.01)

(58) Field of Classification Search
CPC ..... E04H 15/38; E04H 15/48
See application file for complete search history.

(56) References Cited

U.S. PATENT DOCUMENTS 3,121,439 A * 2/1964 Moltchan ..... E04H 15/38 D25/19
3,513,861 A * 5/1970 Johnson ..... E04H 15/38 135/132
3,906,968 A * 9/1975 Black ..... E04H 15/38 135/132
4,069,833 A * 1/1978 Johansson ..... E04H 15/38 135/132
9,506,269 B2 * 11/2016 Armstrong ..... E04H 15/06
9,856,672 B2 * 1/2018 Allen ..... E04H 15/38
10,180,013 B2 1/2019 Allen et al.
2005/0155299 A1 * 7/2005 Alspaugh ..... E04H 15/38 52/79.1
2011/0192437 A1 * 8/2011 Adams ..... A63B 71/02 135/124

FOREIGN PATENT DOCUMENTS

KR 20200079973 A * 7/2020
WO WO-2015009738 A1 * 1/2015 ..... E04H 15/38

OTHER PUBLICATIONS

There and Back, "E-Z Up Envoy 10x10 Instant Shelter Canopy-Middle Truss Bars 40 Replacement Parts," Amazon, https://www.amazon.com/Z-Instant-Canopy-MIDDLE-Replacement-Parts/dp/B0759ZYZSW.

* cited by examiner

*Primary Examiner* — David R Dunn
*Assistant Examiner* — Danielle Jackson
(74) *Attorney, Agent, or Firm* — C. Brandon Browning; Maynard Nexsen PC

(57) ABSTRACT

A tent frame assembly is disclosed including a first hub and second hub spaced apart from the first hub. The assembly can include one or more collapsible frame members each having a first end and a second end. The first ends can be coupled to the first hub and the second ends can be coupled to the second hub. The frame members can include a first frame member and a second frame member that have first ends and second ends that are pivotably coupled to the first hub and second hub, respectively. The one or more collapsible frame members can include a third frame member that includes a first end statically coupled to the first hub and a second end statically coupled to the second hub, and a connecting section. The connecting section can bisect the tent frame assembly when the tent frame is in an extended position.

19 Claims, 12 Drawing Sheets

TENT FRAME ASSEMBLY

RELATED APPLICATION

This application is related to U.S. Pat. No. 10,180,013 filed on Dec. 4, 2017, which is a continuation of U.S. Pat. No. 9,856,672, filed on Sep. 12, 2016, which claims the benefit of U.S. Provisional App. No. 62/217,408, filed on Sep. 11, 2015, the contents of which are herein incorporated by reference in their entirety.

FIELD OF THE DISCLOSURE

This disclosure generally relates to a tent frame assembly, and more particularly to a tent frame assembly that is extendable and collapsible and includes one or more hubs, and one or more collapsible frame members.

BACKGROUND

On-field privacy for injured players is either non-existent or provided in a limited capacity by sports medicine staff or others holding towels near the injured players to obscure the view of the injured players, which may compromise medical confidentiality. Thus, on-field treatment leaves the player in full or partial view of media, fans, and the opposing team. Previous solutions to this problem include tent frames that include a cross-member running along the ground that provides support to the tent frame when the tent frame is in a deployed configuration. However, such tent frames can prevent the tent frame from being assembled around an injured player. Instead, the tent frame may be assembled in a location close the injured player, and the injured player may have to be transported into the assembled tent frame. Accordingly, there is a need for providing improved tent frame assemblies that can be quickly deployed around an injured player without the need for moving the injured player.

The embodiments disclosed herein are directed to these and other considerations.

BRIEF SUMMARY

In one aspect a tent frame assembly is disclosed. The tent frame assembly may include a first hub and a second hub. The second hub can be separate and spaced apart from the first hub. The tent frame assembly can include at least a first frame member and a second frame member. Each frame member may include a first end and a second end. The first ends of the frame members may be coupled to the first hub, and the second ends of the frame members may be coupled to the second hub. The first end and the second end of at least the second frame member may be pivotably coupled to the first hub and the second hub, respectively. The tent frame assembly may include a third frame member. The third frame member may include a first end statically coupled to the first hub, a second end statically coupled to the second hub, and a connecting section. The connecting section can include a first V-shaped section and a second V-shaped section. The first V-shaped section can include a first apex orientated downwards and the second V-shaped section can include a second apex oriented upwards. The second frame member may be pivotable relative to the first and second hubs between an extended position and a collapsed position. In the extended position, the second frame member may be spaced apart from the first frame member and in the collapsed position, the frame members may be stacked adjacent to each other.

In some embodiments, the second V-shaped section is formed of two parallel members, and the first V-shaped section is formed of a single member. The single member of the first V-shaped section may pass between the two parallel members at least once. In some embodiments, the single member may pass between the two parallel members at least twice.

In some embodiments, the first and second hub each comprise a first hub portion and a second hub portion detachably connected to the first hub portion. In a connected configuration, the first hub portion and the second hub portion can form a plurality of channels each configured to receive a respective frame member.

In some embodiments, the tent assembly can include a first floor member, a second floor member, a third floor member, and a fourth floor member. In the extended position, the first floor member and the second floor member are expanded to be disposed approximately 180 degrees away from each other, the third floor member and the fourth floor member are expanded to be disposed approximately 180 degrees away from each other, and the first frame member, the second frame member, and the third frame member are expanded to be disposed between approximately 30 degrees and 60 degrees away from each other.

In some embodiments, the plurality of channels can include a first channel configured to receive the first frame member, a second channel configured to receive the second frame member, a third channel configured to receive the third frame member, and two floor channels each configured to receive a respective floor member.

In some embodiments, the tent frame assembly can include a first support assembly and a second support assembly. The first support assembly can include a first sliding member that is slideably coupled to the first end of the third frame member. The first support assembly can include a first support strut including a first end and a second end, the first end pivotably coupled to the first sliding member and the second end pivotably coupled to the first floor member. The first support assembly can include a second support strut including a first end and a second end. The first end can be pivotably coupled to the first sliding member and the second end can be pivotably coupled to the second floor member. The first support assembly can include a first locking pin. The second support assembly can include a second sliding member slideably coupled to the second end of the third frame member. The second support assembly can include a first support strut including a first end and a second end, the first end pivotably coupled to the second sliding member and the second end pivotably coupled to the third floor member. The second support assembly can include a second support strut including a first end and a second end, the first end pivotably coupled to the second sliding member and the second end pivotably coupled to the fourth floor member. The second support assembly can include a second locking pin.

In some embodiments, the first and second sliding member are configured to slide vertically to change the tent frame assembly between the collapsed position and the extended position.

In some embodiments, the first locking pin and the second locking pin are configured to selectively lock the tent frame into the extended position.

In some embodiments, the first channel is configured to allow the first frame member to pivot between the collapsed position and the extended position, the second channel is configured to allow the second frame member to pivot between the collapsed position and the extended position, and the two floor channels are each configured to allow a respective floor member to pivot between the collapsed position and the extended position.

In some embodiments, the connecting section of third frame member bisects the tent frame assembly when the tent frame assembly is in the extended position.

In another aspect, a tent frame assembly is disclosed. The tent frame assembly can include a first hub, a second hub separate and spaced apart from the first hub and one or more collapsible frame member. The one or more collapsible frame members can each have a first end and a second end. The first ends of the one or more collapsible frame members can be coupled to the first hub, and the second ends of the one or more collapsible frame members can be coupled to the second hub. The one or more collapsible frame members can include a first frame member and a second frame member. The first end and the second end of the first frame member and second frame member can be pivotably coupled to the first hub and second hub, respectively. The one or more collapsible frame members can include a third frame member including a first end statically coupled to the first hub, a second end statically coupled to the second hub, and a connecting section. The connecting section can bisect the tent frame assembly when the tent frame assembly is in an extended position.

In some embodiments, the second frame member can be pivotable relative to the first and second hubs between the extended position in which the second frame member is spaced apart from the first frame member and the third frame member and a collapsed position in which the frame members are stacked adjacent to each other.

In some embodiments, the connecting section of the third collapsible frame member includes a first V-shaped section having a first apex oriented downwards and a second V-shaped section having a second apex oriented upwards.

In some embodiments, each of the first and second hub include a first hub portion and a second hub portion detachably connected to the first hub portion. In a connected configuration, the first hub portion and the second hub portion form a plurality of channels each configured to receive a respective frame member.

In some embodiments, the tent frame assembly includes a first floor member, a second floor member, a third floor member, and a fourth floor member. In the extended position the first floor member and the second floor member are expanded to be disposed approximately 180 degrees away from each other, the third floor member and the fourth floor member are expanded to be disposed approximately 180 degrees away from each other, and the first frame member, the second frame member, and the third frame member are expanded to be disposed between approximately 30 degrees and 60 degrees away from each other.

In some embodiments, the plurality of channels include a first channel configured to receive the first frame member, a second channel configured to receive the second frame member, a third channel configured to receive the third frame member, and two floor channels each configured to receive a respective floor member.

In some embodiments, the tent frame assembly can include a first support assembly and a second support assembly. The first support assembly can include a first sliding member that is slideably coupled to the first end of the third frame member. The first support assembly can include a first support strut including a first end and a second end, the first end pivotably coupled to the first sliding member and the second end pivotably coupled to the first floor member. The first support assembly can include a second support strut including a first end and a second end. The first end can be pivotably coupled to the first sliding member and the second end can be pivotably coupled to the second floor member. The first support assembly can include a first locking pin. The second support assembly can include a second sliding member slideably coupled to the second end of the third frame member. The second support assembly can include a first support strut including a first end and a second end, the first end pivotably coupled to the second sliding member and the second end pivotably coupled to the third floor member. The second support assembly can include a second support strut including a first end and a second end, the first end pivotably coupled to the second sliding member and the second end pivotably coupled to the fourth floor member. The second support assembly can include a second locking pin. The first locking pin and the second locking pin can be configured to selectively lock the tent frame assembly into the extended position.

In some embodiments, the first and second sliding members are configured to slide vertically to change the tent frame assembly between the collapsed position and the extended position.

In some embodiments, the first channel is configured to allow the first frame member to pivot between the collapsed position and the extended position, the second channel is configured to allow the second frame member to pivot between the collapsed position and the extended positon, and the two floor channels are each configured to allow a respective floor member to pivot between the collapsed position and the extended position.

BRIEF DESCRIPTION OF THE DRAWINGS

The present disclosure can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

According to aspects of the present disclosure, a tent frame assembly is disclosed. The tent frame assembly may be configured for providing privacy to injured players and medical staff during a sporting game. The disclosed tent frame assemblies can also be used to provide privacy to participants injured at events including but not limited to concerts, festivals, and others. In addition, some implementations may provide a barrier from the elements, such as rain or wind. The disclosed tent frame assemblies can be assembled in-place thereby allowing medical staff to treat the injured person without requiring the injured person be moved from the area of injury. Once the injured person is treated, the tent frame assembly can be collapsed. The tent frame assembly is configured to not obstruct the view of event participants once the tent frame assembly is collapsed.

Figure 1:
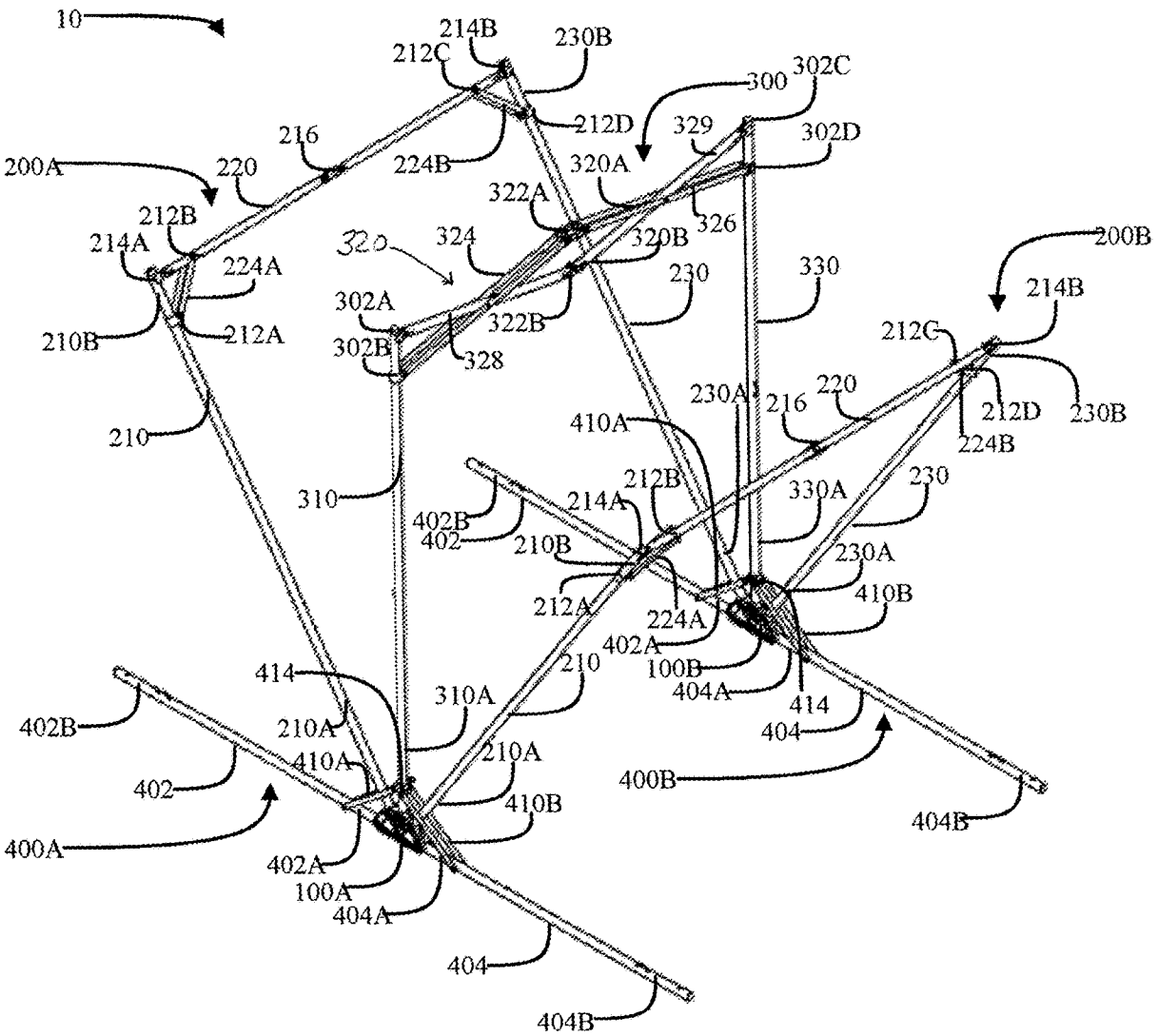
FIG. 1 is a perspective view of a tent frame assembly, in accordance with aspects of the disclosed embodiments.

FIG. 1 depicts a perspective view of a tent frame assembly 10 in an extended position, in accordance with aspects of the disclosed embodiments. Tent frame assembly 10 can include a first hub 100A and a second hub 100B that is spaced apart from the first hub 100A. Tent frame assembly 10 can include frame members 200 including a first frame member 200A and a second frame member 200B and a third frame member 300. According to some embodiments, first frame member 200A and second frame member 200B can be pivotably coupled to each hub 100 and third frame member 300 can be statically coupled to each hub 100. In some examples, the tent frame assembly also includes floor member assemblies 400A and 400B. Floor member assembly 400A can include a floor member 402 and a floor member 404. Similarly, floor member assembly 400B can include a floor member 402 and floor member 404.

Floor members 402, 404 of floor assembly 400A, 400B can include first ends 402A, 404A and second ends 402B, 404B. First ends 402A, 404A of floor assembly 400A can be configured to be connected to first hub 100A and first ends 402A, 404A of floor assembly 400B can be configured to be connected to second hub 100B. In an extended position (e.g., deployed configuration) of tent frame assembly 10, the second ends 402B, 404B of floor assemblies 400A, 400B can be configured to be disposed approximately 180 degrees away from each other. The floor assemblies 400A, 400B can be configured to provide stability to tent frame assembly 10 when tent frame assembly is in the extended position. In the extended position first frame member 200A, second frame member 200B, and third frame member 300 can be configured to be disposed between approximately 30 degrees to approximately 60 degrees from each other. That is, first frame 200A can be disposed between approximately 30 degrees to approximately 60 degrees from third frame member 300 and second frame 200B can be disposed between approximately 30 degrees to approximately 60 degrees from the third frame member 300 when tent frame assembly 10 is in the extended, deployed configuration.

First frame member 200A and second frame member 200B each can include a first section 210, connecting section 220, and second section 230. First section 210 can include a hub end 210A attached to hub 100A and a connecting end 210B that is attached to the connecting section 220 via junction 214A. Second section 230 can include a hub end 230A attached to hub 100B and a connecting end 230B that is attached to the connecting section 220 via junction 214B. In some examples, junction 214A can allow connecting section 220 to pivot with respect to first section 210, and junction 214B can allow connecting section 220 to pivot with respect to second section 230. For example, junctions 214A, 214B can include fasteners that hold first section 210, second section 230, and connecting section 220 together while allowing second section to pivot with respect to first section 210 and second section 230 while tent frame assembly 10 is being moved from a collapsed position to an extended (e.g., deployed) position.

The first frame member 200A and second frame member 200B may each include a first support 224A that connects the first section 210 with connecting section 220 via junctions 212A, 212B. Similarly, first frame member 200A and second frame member 200B may each include a second support 224B that connects the second section 230 with connecting section 220 via junctions 212C, 212D. The first support 224A and second support 224B may add structural rigidity to tent frame assembly 10 to prevent frame members 200 from collapsing while the tent frame assembly 10 is in the extended (e.g., deployed) position. The connecting section 220 of frame members 200 can include a pivotable junction 216. Pivotable junction 216 allows connecting section 220 to fold when the tent frame assembly is moved into the collapsed position to reduce space use and to facilitate storage of tent frame assembly 10. The collapsed position of tent frame assembly 10 is discussed in more detail with respect to FIGS. 8-9.

The third frame member 300 can include first section 310, connecting section 320, and second section 330. First section 310 can include a first end 310A that is statically coupled to the first hub 100A. Second section 330 can include a first end 330A that is statically coupled to the second hub 100B. Connecting section 320 can include a V-shaped section 320B and a V-shaped section 320A. V-shaped section 320A can include an apex 322A that is oriented upwards when the tent frame assembly 10 is in an extended position as shown in FIG. 1. V-shaped section 320B can include an apex 322B that is oriented downwards when the tent frame assembly is in an extended position as shown in FIG. 1. Apex 322A can connect first and second portions 324, 326 of V-shaped section 320A, and apex 322B can connect first and second portions 328, 330 of V-shaped section 320B. Apex 322A can be a pivotable joint or hinge that allows first portion 324 to pivot or hinge with respect to second portion 326, for example when tent frame assembly 10 is moved from a collapsed position to an extended, deployed position. Similarly, apex 322B can be a pivotable joint or hinge that allows first portion 328 to pivot or hinge with respect to second portion 329, for example when tent frame assembly 10 is moved from a collapsed position to an extended, deployed position. In some examples, first portion 324 and second portion 326 of V-shaped section 320A can each comprise two distinct frame portions as shown in FIG. 1 while first portion 328 and second portion 329 can each comprise a single frame portion. Although not pictured in FIG. 1, in some examples, first portion 328 and second portion 329 can each comprise two distinct frame portions and conversely first portion 324 and second portion 326 can each comprise a single frame portion. In any case, as shown in FIG. 1, first portion 328 of V-shaped section 320B can pass between the two distinct frame portions of first portion 324. Similarly, second portion 329 of V-shaped section 320B can pass between the two distinct frame portions of second portion 326. The combination of V-shaped section 320A and V-shaped section 320B allow for third frame member 300 to be collapsible and extendable along an axis parallel to connecting portion 320. In some examples, connecting portion 320 bisects tent frame assembly 10 when tent frame assembly 10 is in an expanded, deployed position.

First section 310 and second section 330 can be connected by connecting section 320. For example, first section 310 can be connected to connecting section 320 via junctions 302A, 302B. Junctions 302A, 302B can allow connecting section 320 to pivot with respect to first section 310, for example when tent frame assembly 10 is moved from a collapsed position to an extended, deployed position. Similarly, second section 330 can be connected to connecting section 320 via junctions 302C, 302D. Junctions 302C, 302D can allow connecting section 320 to pivot with respect to first section 310, for example when tent frame assembly 10 is moved from a collapsed position to an extended, deployed position. Connecting section 320 offers advantages over previously proposed designs for tent frame assemblies, because tent frame assembly 10 can be extended into a deployed position over an injured person without having to either move the injured person into an interior space of the tent frame assembly or without moving the tent frame assembly over the person after deploying the tent frame assembly. Some previous designs included a cross-member connecting first hub 100A with second hub 100B to provide structural rigidity, which did not allow such tent frame assemblies to extended in place over a person. Rather than included a cross member for structural support, certain disclosed embodiments of tent frame assembly 10 include the connecting portion 320 which is sufficient to provide structural rigidity to tent frame assembly without the inclusion of a cross member connecting first hub 100A with second hub 100B.

Figure 2:
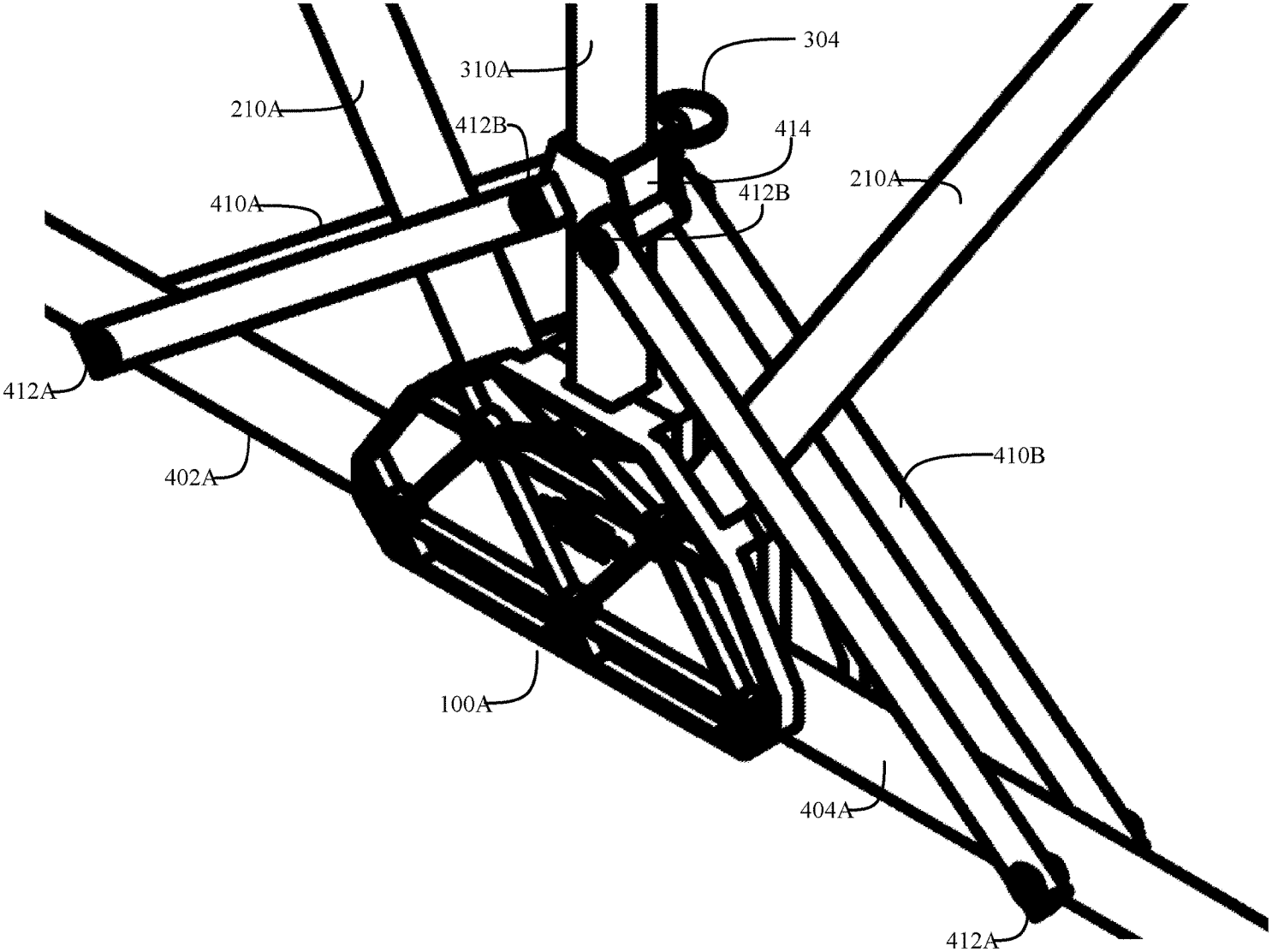
FIG. 2 depicts a hub of the tent frame assembly, in accordance with aspects of the disclosed embodiments.

FIG. 2 depicts hub 100A of the tent frame assembly 10, in accordance with aspects of the disclosed embodiments. It should be noted that hub 100B may be a mirror image of hub 100A and may have similar or the same components to that of hub 100A, and accordingly a full description of hub 100B is omitted here for brevity. As shown, hub 100A is configured to retain first end 402A of floor member 402 and first end 404A of floor member 404 of floor assembly 400A. Although not shown, hub 100B is also configured to retain first end 402A of floor member 402 and first end 404A of floor member 404 of floor assembly 400B. Hub ends 210A can be retained by hub 100A. Although not shown, hub ends 230A can be retained by hub 100B in a similar manner. First end 310A can be retained by hub 100A. In a similar manner, first end 330A can be retained by hub 100B.

Figure 8:
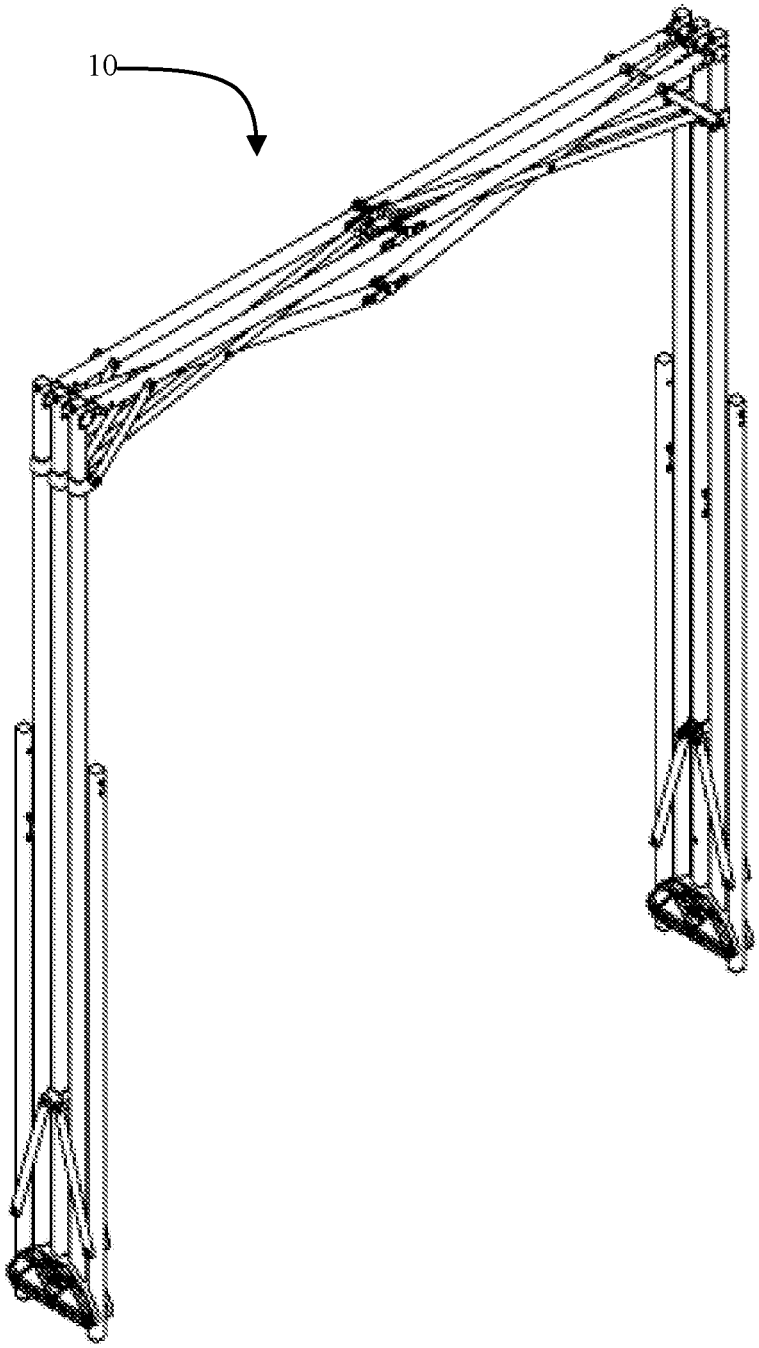
FIG. 8 depicts a tent frame assembly with frame members in a partially collapsed configuration, in accordance with aspects of the disclosed embodiments.
Figure 9:
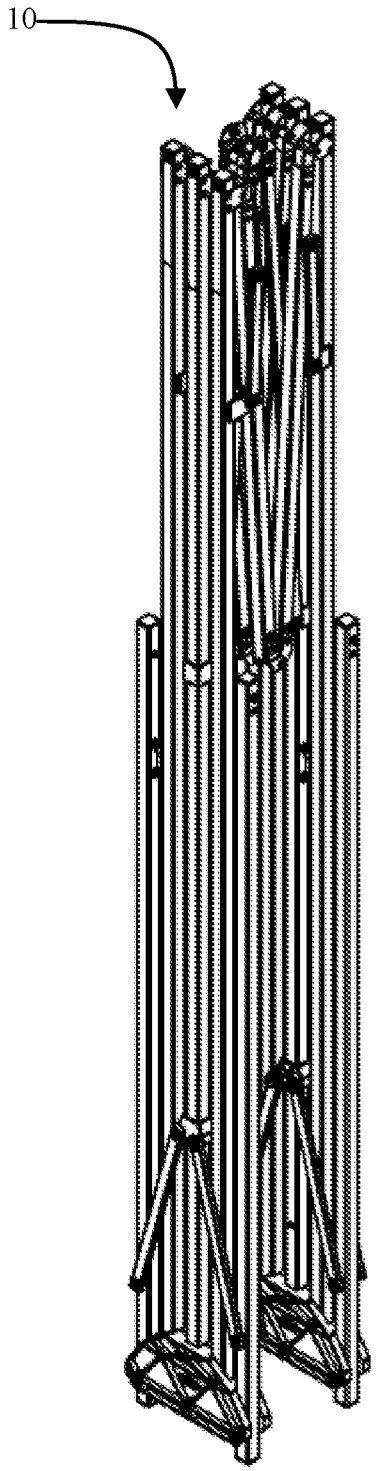
FIG. 9 depicts a tent frame assembly in a fully collapsed configuration, in accordance with aspects of the disclosed embodiments.

As shown, retained upon first section 310 of third frame member 300 can be a sliding member 414. Sliding member retains support struts 410A, 410B, which are engaged to the sliding member 414 with junctions 412B. Sliding member 414 can be configured to slide up and down the first section 310 as tent frame assembly moves between the collapsed position and the extended, deployed position. When positioned in the extended, deployed position, locking pin 304 is configured to retain sliding member 414 in the deployed position, thereby keeping floor members 402, 404 of floor assembly 400A in the extended position and preventing floor members 402, 404 from pivoting up towards first section 310 about hub 100A. Sliding member 414 as shown in FIG. 2 is positioned in the extended, deployed position of tent frame assembly 10. When tent frame assembly 10 is collapsed (as shown in FIGS. 8-9), sliding member 414 slides vertically up first section 310 of third frame member 300. As sliding member 414 slides up first section 310 of third frame member 300, support struts 410A, 410B pull floor members 402, 404 of floor assembly 400A such that floor members 402, 404 pivot about hub 100A towards first section 310 of third frame member 300 until floor member 402, 404 abut sections 210 of first and second frame members 200A, 200B, respectively. As will be described in more detail with respect to FIGS. 4A-4B, floor members 402, 404, and first sections 210 of frames 200A, 200B continue to pivot towards first section 310 as sliding member 414 slides up first section 310 until floor members 402, 404, first sections 210 of frames 200A, 200B, and first section 310 of third frame member 300 are adjacent to each other in the collapsed position of tent frame assembly 10.

In a similar manner, a sliding member 414 can be disposed on second section 330 of third frame member 300. Sliding member 414 retains a support struts 410A, 410B, which are engaged to the sliding member 414 with junctions 412B. Sliding member 414 can be configured to slide up and down the second section 330 as tent frame assembly moves between the collapsed position and the extended, deployed position. When positioned in the extended, deployed position, a locking pin 304 is configured to retain sliding member 414 in the deployed position, thereby keeping floor members 402, 404 of floor assembly 400B in the extended position and preventing floor members 402, 404 from pivoting up towards second section 330 about hub 100B. Sliding member 414 as shown in FIG. 2 is positioned in the extended, deployed position of tent frame assembly 10. When tent frame assembly 10 is collapsed (as shown in FIGS. 8-9), sliding member 414 slides vertically up second section 330 of third frame member 300. As sliding member 414 slides up second section 330 of third frame member 300, support struts 410A, 410B pull floor members 402, 404 of floor assembly 400B such that floor members 402, 404 pivot about hub 100B towards second section 330 of third frame member 300 until floor member 402, 404 abut second sections 230 of first and second frame members 200A, 200B, respectively. As will be described in more detail with respect to FIGS. 4A-4B, floor members 402, 404, and sections 230 of frames 200A, 200B continue to pivot towards second section 330 as sliding member 414 slides up second section 330 until floor members 402, 404, second sections 230 of frames 200A, 200B, and second section 330 of third frame member 300 are adjacent to each other in the collapsed position of tent frame assembly 10.

Figure 3:
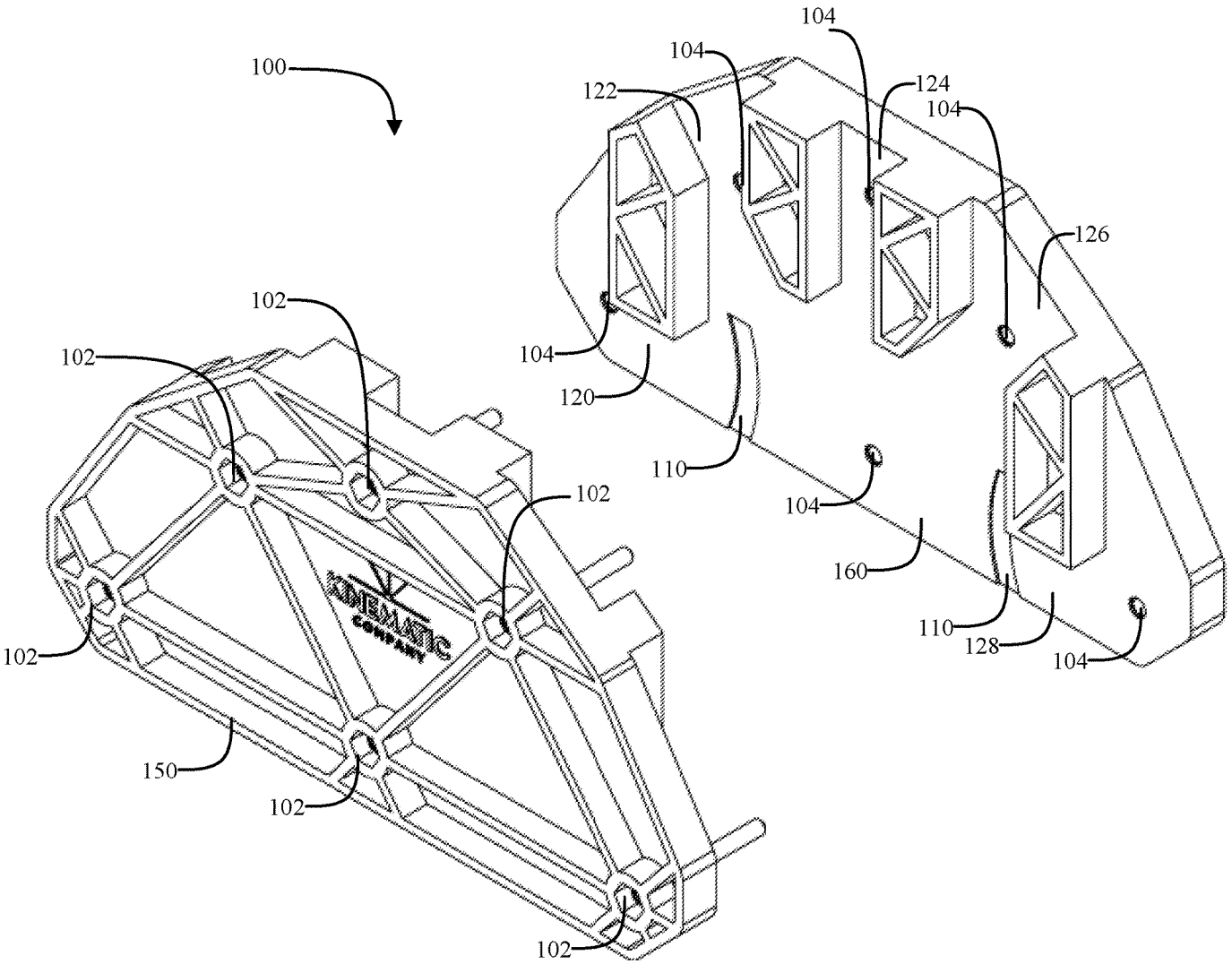
FIG. 3 depicts an exploded view of the hub of FIG. 2 including two hub portions, in accordance with aspects of the disclosed embodiments.

FIG. 3 depicts an exploded view of the hubs 100 including two hub portions 150 and 160, in accordance with aspects of the disclosed embodiments. As described with respect to FIG. 2, hubs 100A and 100B are substantially similar, and are discussed with respect to FIG. 3 simultaneously in reference to exemplary hub 100. As shown in FIG. 3, hub 100 can include hub portion 150 and hub portion 160. Hub portion 150 includes a plurality of fasteners 102 that have complementary fastener apertures 104. In some examples, fastener apertures may be threaded with a thread that is complementary to the plurality of fasteners. In other examples, fastener apertures may not be threaded, and fasteners 102 may be configured to fasten through fastener apertures 104 with other methods such as a threaded nut that mates to fasteners 102 on the back side of hub portion 160. Fasteners 102 and fastener apertures 104 may be used to fasten the frame members of tent frame assembly to both hub portion 150 and portion 160 of hub 100 as shown in FIGS. 4A-4B.

Hub portions 150 and 160 also form a plurality of channels. For example, the combination of hub portion 150 and hub portion 160 forms channel 120, channel 122, channel 124, channel 126, and channel 128. Channel 120 can be sized to fit hub end 402A of floor member 402. Channel 122 can be sized to fit hub end 210A of first section 210A (hub 100A) or hub end 230A of second section 230A (hub 100B). Channel 124 can be sized to fit hub end 310A of first section 310 (hub 100A) or hub end 330A of second section 330 (hub 100B). Channel 126 can be sized to fit hub end 210A of first section 210A (hub 100A) or hub end 230A of second section 230A (hub 100B). Channel 128 can be sized to fit hub end 404A of floor member 404. Hub 160 can include cutouts 110. Cutouts 110 can be configured to allow hub ends 402A, 404A of floor members 402, 404, respectively, to pivot between hub portions 150, 160 without interfering with the wall of either hub portion 150 or hub portion 160.

Figure 4A:
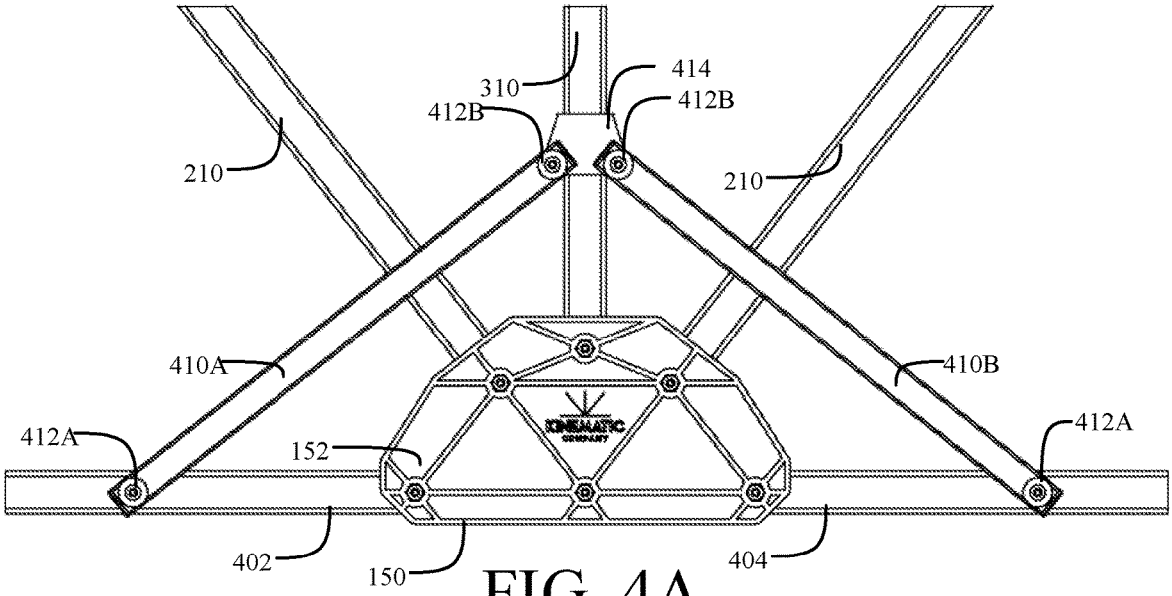
FIG. 4A depicts a front view of a hub portion of FIG. 3, in accordance with aspects of the disclosed embodiments.
Figure 4B:
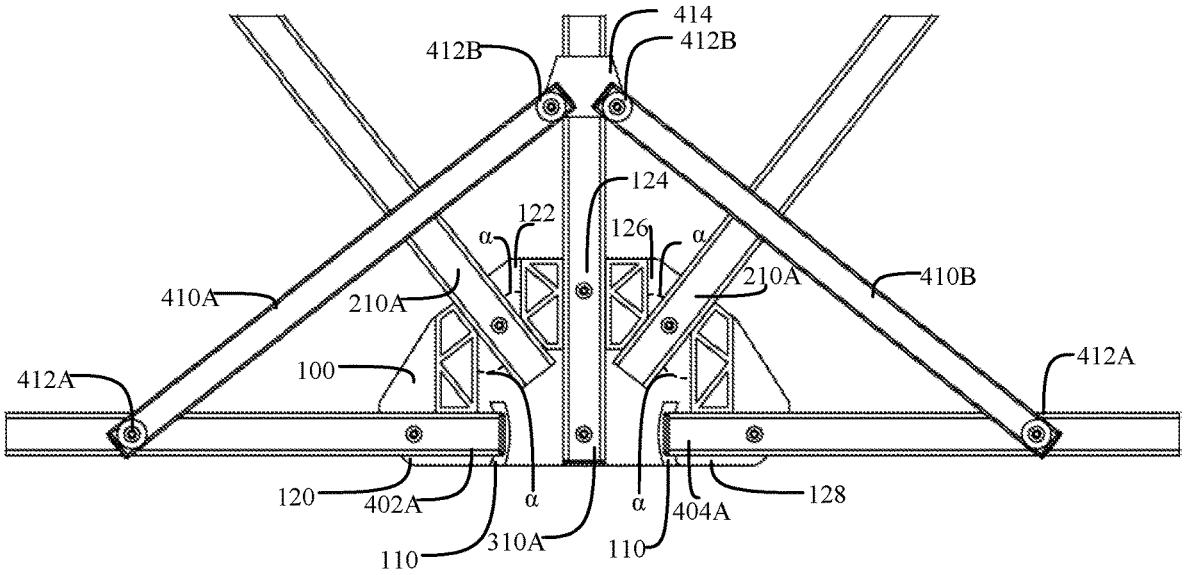
FIG. 4B depicts a front view of a hub portion of FIG. 3 with a front hub plate removed, in accordance with aspects of the disclosed embodiments.

FIG. 4A-4B depicts front views of hub portion 150 of FIG. 3 with and without removable hub plate 152, in accordance with aspects of the disclosed embodiments. As shown in FIG. 3 with respect to hub portion 160, hub portion 150, when combined with hub portion 160, includes channels 120, 122, 124, 126, and 128 that are configured to retain hub ends 402A, 210A (hub 100A), 230 (hub 100B), and 404A. FIG. 4A shows hub portion 150 with removable hub plate 152. As shown in FIG. 4B, behind removable hub plate 152, hub ends 402A, 210A, and 404A are configured to pivot with respect to hub 100. For example, for hub 100A, floor members 402, 404 can rotate approximately 90 degrees towards first section 310 about hub 100A when tent frame assembly 10 is moved from the extended, deployed position to the collapsed position, due to channels 120 and 128. Similarly, channels 122, 126 allow first sections 210 to rotate through angle $\alpha$ about hub 100A when tent frame assembly 10 is moved from the extended, deployed position to the collapsed position. In some examples, angle $\alpha$ can be between approximately 30 to approximately 60 degrees. As shown, first section 310 can be statically coupled to hub 100A. While hub ends 402A, 404A, and 210A are attached to hub 100A via a single fastener 102, hub end 310A is attached to hub 100A with two fasteners 102. Being attached to with a single fastener allows hub ends 402A, 404A, and 210A to pivot with respect to hub 100A, while being attached to hub 100A with multiple fasteners 102 prevents hub end 310A from pivoting with respect to hub 100A.

Although not pictured, hub 100B operates in a similar manner as hub 100A. For example, for hub 100B, floor members 402, 404 can rotate approximately 90 degrees towards first section 310 about hub 100B when tent frame assembly 10 is moved from the extended, deployed position to the collapsed position, due to channels 120 and 128. Similarly, channels 122, 126 allow second sections 230A to rotate through angle $\alpha$ about hub 100B when tent frame assembly 10 is moved from the extended, deployed position to the collapsed position. In some examples, angle $\alpha$ can be between approximately 30 to approximately 60 degrees. Second section 330 can be statically coupled to hub 100B inside channel 124. While hub ends 402A, 404A, and 230A are attached to hub 100B via a single fastener 102, hub end 330A is attached to hub 100B with two fasteners 102. Being attached to with a single fastener allows hub ends 402A, 404A, and 230A to pivot with respect to hub 100B, while being attached to hub 100A with multiple fasteners 102 prevents hub end 330A from pivoting with respect to hub 100B.

Figure 5B:
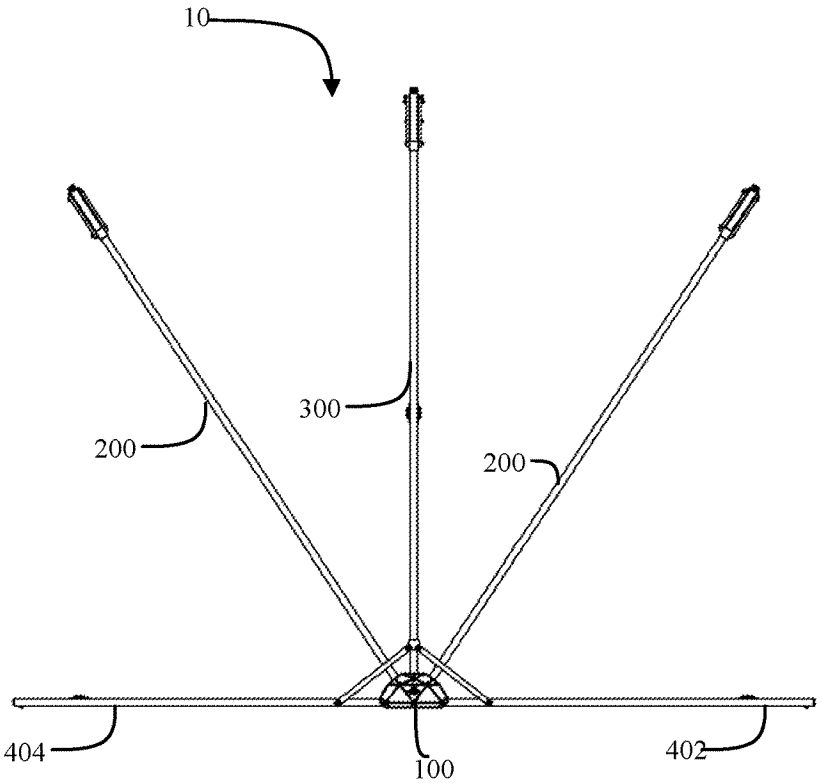
FIG. 5B depicts a second side view of a tent frame assembly, in accordance with aspects of the disclosed embodiments.
Figure 5A:
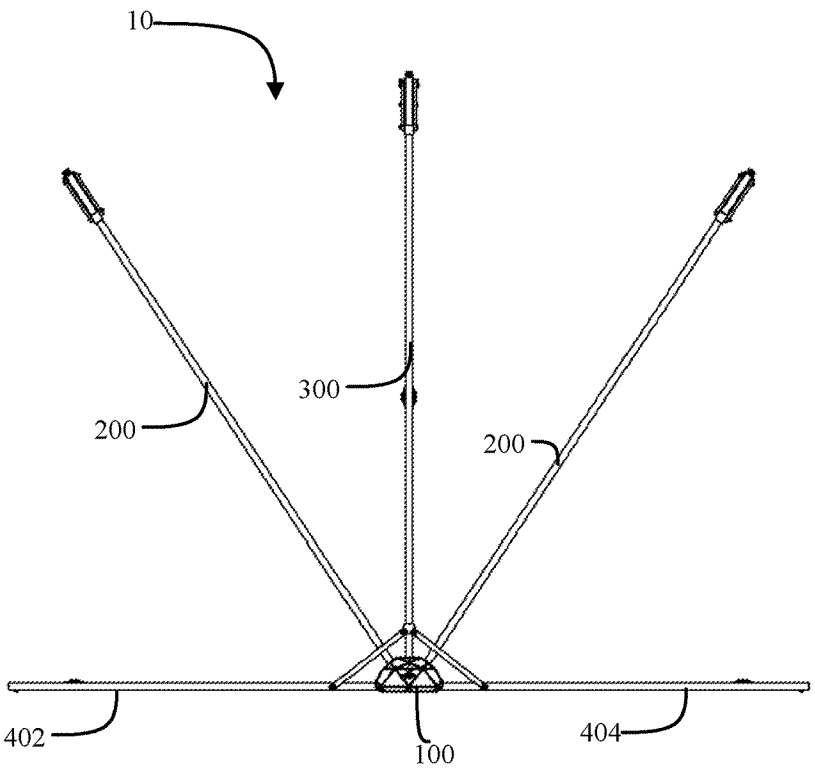
FIG. 5A depicts a first side view of a tent frame assembly, in accordance with aspects of the disclosed embodiments.
Figure 6B:
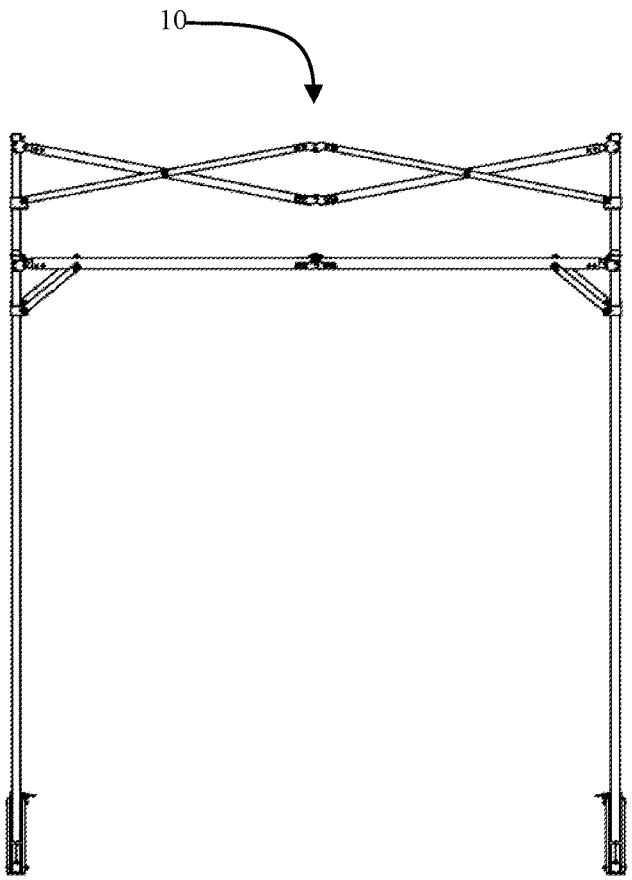
FIG. 6B depicts a rear view of a tent frame assembly, in accordance with aspects of the disclosed embodiments.
Figure 6A:
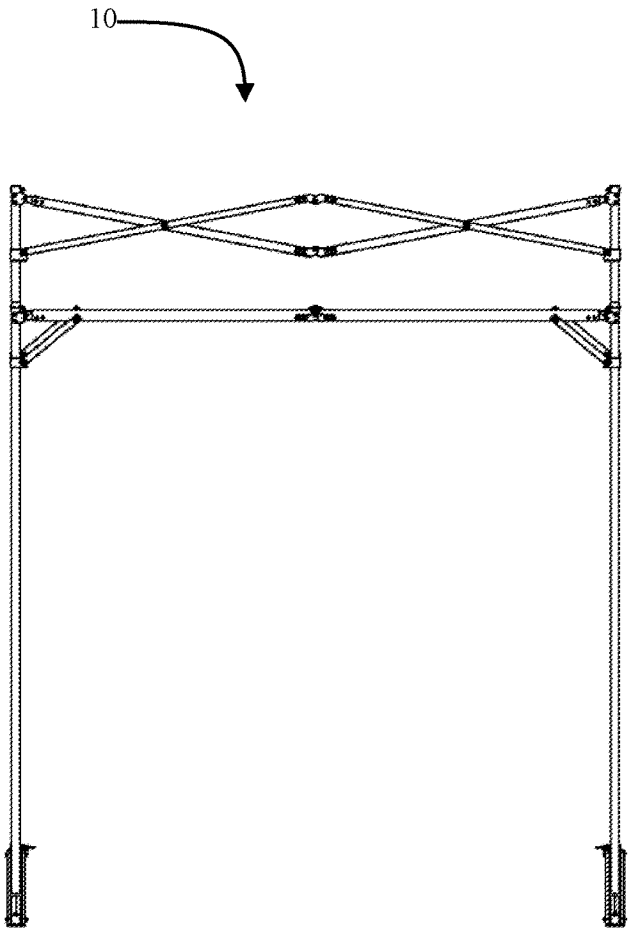
FIG. 6A depicts a front view of a tent frame assembly, in accordance with aspects of the disclosed embodiments.
Figure 7B:
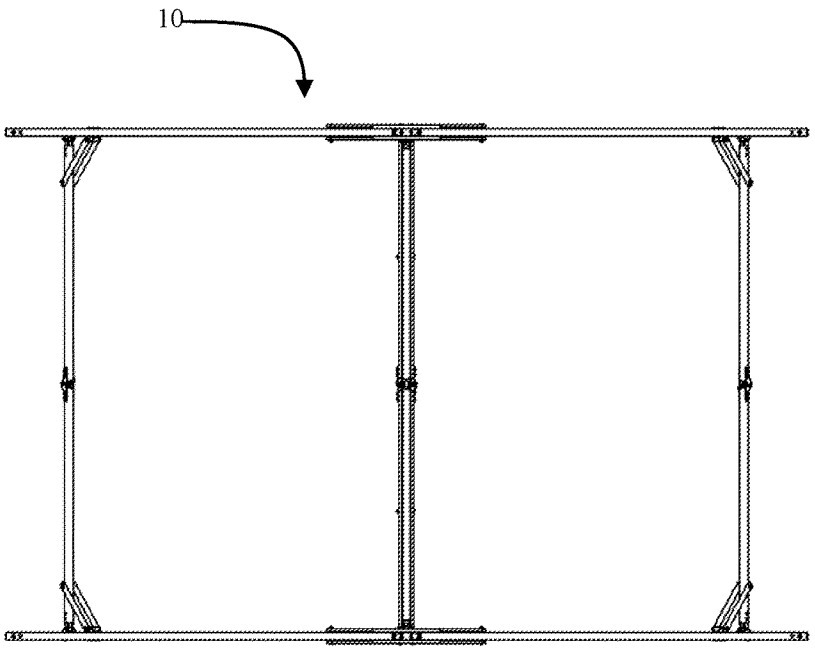
FIG. 7B depicts a bottom view of a tent frame assembly, in accordance with aspects of the disclosed embodiments.
Figure 7A:
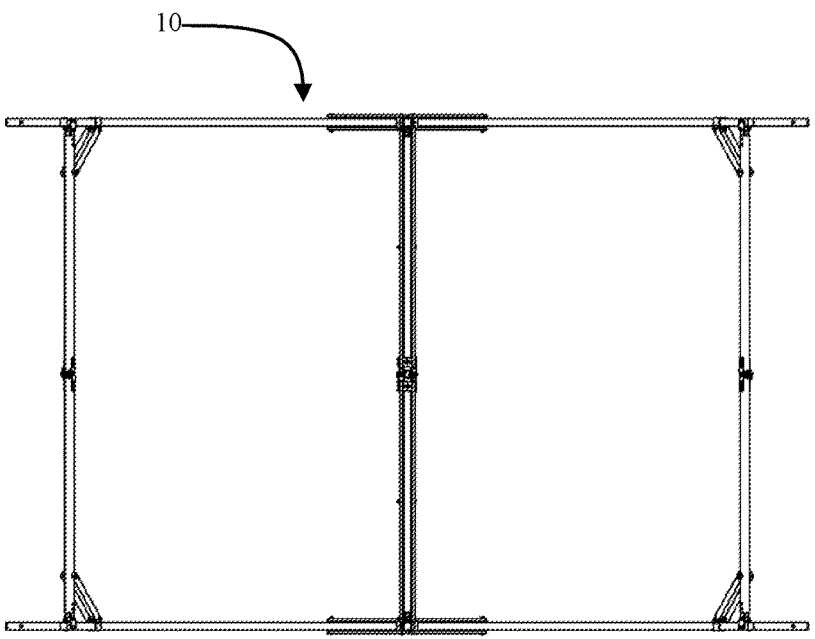
FIG. 7A depicts a top view of a tent frame assembly, in accordance with aspects of the disclosed embodiments.

FIGS. 5A-FIG. 7B depict various perspectives of tent frame assembly 10. More particularly, FIGS. 5A-5B depict side views of tent frame assembly 10, FIGS. 6A-6B depict front and rear views of tent frame assembly 10, and FIGS. 7A-7B depict top and bottom view of tent frame assembly 10. As can be seen, first side of tent frame assembly 10 as shown in FIG. 5A and second side of tent frame assembly 10 as shown in FIG. 5B are mirror images of one another. As can be seen, front side of tent frame assembly 10 as shown in FIG. 6A and rear side of tent frame assembly 10 as shown in FIG. 6B are mirror images of one another.

FIG. 8 depicts a tent frame assembly with frame members in a partially collapsed configuration, in accordance with aspects of the disclosed embodiments. In FIG. 8, the locking pins 304 are released, allowing sliding members 414 to slide up, bringing sections 402, 404, 210, and 310 parallel to one another by pivoting with respect to hub 100A and sections 402, 404, 230, and 330 parallel to one another by pivoting with respect to hub 100B, as described with respect to FIG. 2.

FIG. 9 depicts a tent frame assembly 10 in a fully collapsed configuration, in accordance with aspects of the disclosed embodiments. In FIG. 9, the junctions 216, 322A, 322B, have been folded, allowing tent frame assembly to move from the partially collapsed position shown in FIG. 8 to the completely collapsed position. In this position, tent frame assembly 10 can be conveniently stored without taking up much space or obscuring the view of event participants.

Figure 10:
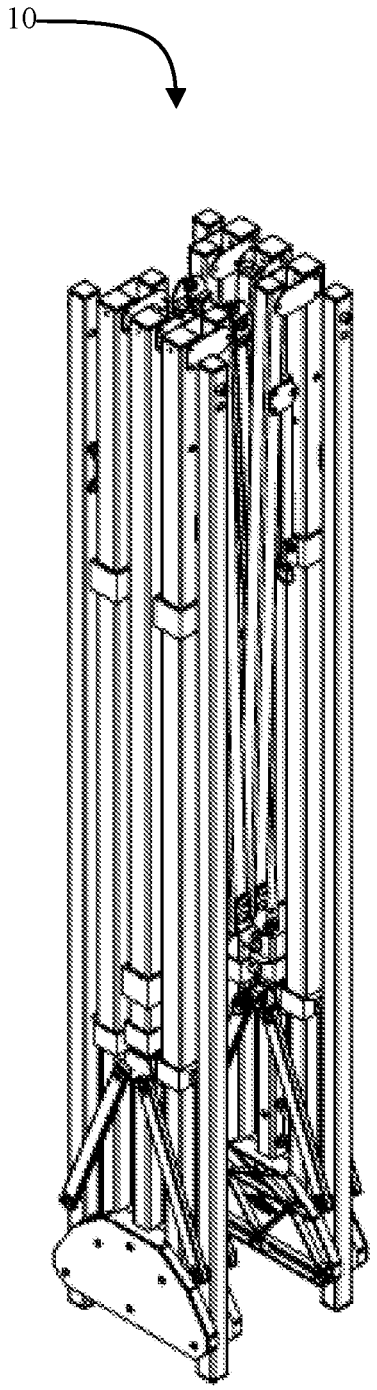
FIG. 10 depicts a tent frame assembly in a fully collapsed configuration with retracted telescoping frame members, in accordance with aspects of the disclosed embodiments.

FIG. 10 depicts a tent frame assembly 10 in a fully collapsed configuration with telescoping frame members retracted. In some examples, tent frame assembly 10 can have frame members 200, 300 that are telescoping. As shown in FIG. 10, frame members 200, 300 are retracted. In the retracted configuration, frame member 200, 300 can be approximately the length of floor members 400 in the collapsed configuration, further decreasing the storage space required for storing tent frame assembly 10.

Figure 11:
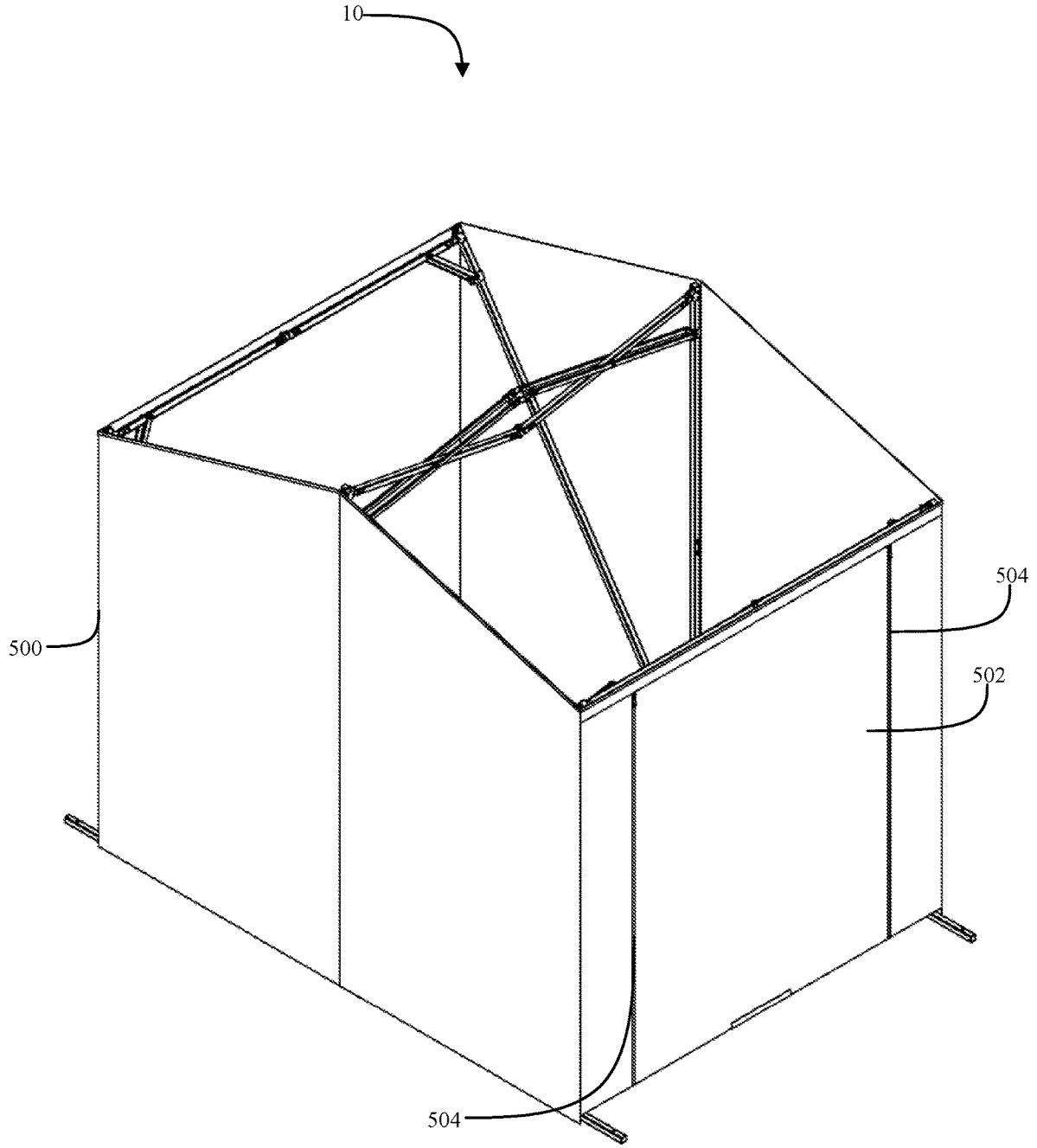
FIG. 11 depicts a tent frame assembly in an extended configuration with a removable side cover, in accordance with aspects of the disclosed embodiments.

FIG. 11 depicts tent frame assembly 10 in an extended, deployed configuration with removable side cover 500. Removable side cover 500 can be detachably connected to tent frame assembly 10 to cover the sides of tent frame assembly 10. According to some examples, removable side cover 500 can be retained on tent frame assembly 10 when tent frame assembly 10 is moved to the fully collapsed positions shown in FIGS. 9-10. Removable side cover 500 can be removed from tent frame assembly when the tent frame assembly is moved to the extended, deployed position to facilitate cleaning, repair, and/or replacement of the removable side cover 500. In some examples, removable side cover 500 can include a door flap 502. Door flap 502 can allow for users of tent frame assembly 10 to enter an exit the interior of tent frame assembly 10 while still enclosing the interior of tent frame assembly and obfuscating its view from the exterior of tent frame assembly 10. Door flap 502 can be fastened to removable side cover 500 with fasteners 504 on each side of door flap 502. Fasteners 504 can be of any suitable type, for example a zipper fastener, buttons, snaps, hook and loop, and/or magnets may be used to fasten door flap 502 to removable side cover 500.

Figure 12:
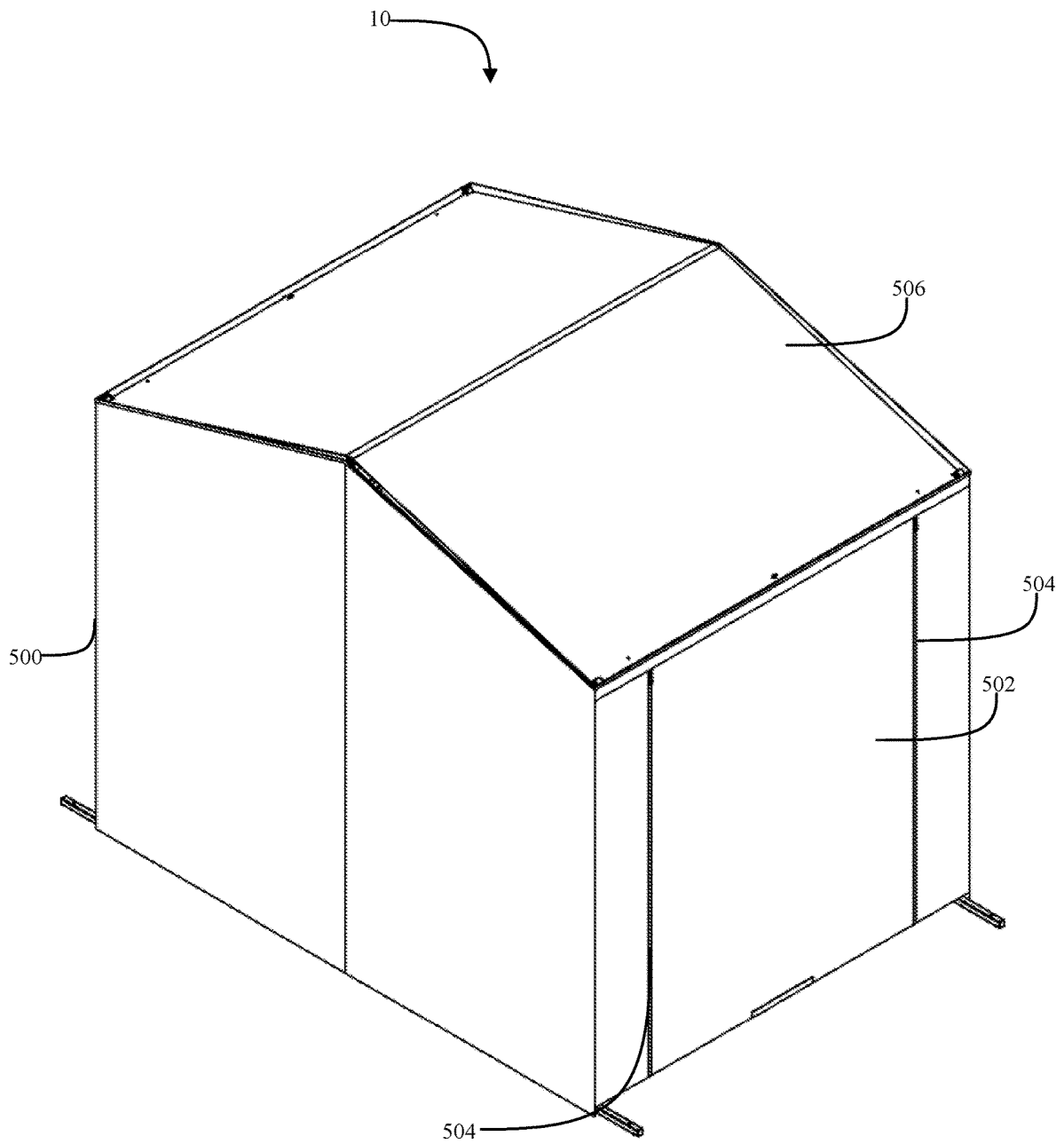
FIG. 12 depicts a tent frame assembly in an extended, deployed configuration with removable side cover and removable top cover, in accordance with aspects of the disclosed embodiments.

FIG. 12 depicts tent frame assembly 10 in an extended, deployed configuration with removable side cover 500 and removable top cover 506. Top cover 506 can be detachably fastened to tent frame assembly 10 to cover a top side of the tent frame assembly 10. Top cover 506 can be used to block users of tent frame assembly from the elements, such as rain or sun. Just as removable side cover 500 can be used without top cover 506, top cover can be attached to tent frame assembly 10 independently without attaching removable side cover 500. As shown in FIG. 12, top cover 506 and removable side cover 500 can be used in tandem to fully enclose tent frame assembly 10.

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

As a further example, variations of apparatus or process parameters (e.g., dimensions, configurations, components, process step order, etc.) may be made to further optimize the provided structures, devices, and methods, as shown and described herein. In any event, the structures and devices, as well as the associated methods, described herein have many applications. Therefore, the disclosed subject matter should not be limited to any single embodiment described herein, but rather should be construed in breadth and scope in accordance with the appended claims.

The terms "about" and "approximately" shall generally mean an acceptable degree of error or variation for the quantity measured given the nature or precision of the measurements. Typical, exemplary degrees of error or variation are within 20 percent (%), preferably within 10%, more preferably within 5%, and still more preferably within 1% of a given value or range of values. Numerical quantities given in this description are approximate unless stated otherwise, meaning that the term "about" or "approximately" can be inferred when not expressly stated.

With reference to the use of the word(s) "comprise," "comprises," and "comprising" in the foregoing description and/or in the following claims, unless the context requires otherwise, those words are used on the basis and clear understanding that they are to be interpreted inclusively, rather than exclusively, and that each of those words is to be so interpreted in construing the foregoing description and/or the following claims.

The term "including" should be interpreted to mean "including but not limited to . . . " unless the context clearly indicate otherwise.

The term "consisting essentially of" means that, in addition to the recited elements, what is claimed may also contain other elements (steps, structures, ingredients, components, etc.) that do not adversely affect the operability of what is claimed for its intended purpose. Such addition of other elements that do not adversely affect the operability of what is claimed for its intended purpose would not constitute a material change in the basic and novel characteristics of what is claimed.

The term "adapted to" means designed or configured to accomplish the specified objective, not simply able to be made to accomplish the specified objective.

The term "capable of" means able to be made to accomplish the specified objective.

The terminology used herein is for the purpose of describing particular embodiments only and is not intended to be limiting. As used herein, the singular forms "a", "an" and "the" are intended to include the plural forms as well (i.e. "at least one"), unless the context clearly indicates otherwise.

The terms "first", "second", and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Terms such as "at least one of A and B" should be understood to mean "only A, only B, or both A and B." The same construction should be applied to longer list (e.g., "at least one of A, B, and C").

What is claimed is:

1. A tent frame assembly comprising:

a first hub;

a second hub, the second hub being separate and spaced apart from the first hub; and at least a first frame member and a second frame member, each frame member having a first end and a second end, the first ends of the frame members being coupled to the first hub, and the second ends of the frame members being coupled to the second hub, wherein the first end and the second end of at least the second frame member are pivotably coupled to the first hub and the second hub, respectively;

a third frame member comprising a first end statically coupled to the first hub, a second end statically coupled to the second hub, and a connecting section comprising a first V-shaped section having a first apex oriented downwards and a second V-shaped section having a second apex oriented upwards; and wherein the second frame member is pivotable relative to the first and second hubs between an extended position in which the second frame member is spaced apart from the first frame member and the third frame member and a collapsed position in which the frame members are stacked adjacent to each other.

2. The tent frame assembly of claim 1, wherein the second V-shaped section is formed of two parallel members, and the first V-shaped section is formed of a single member, wherein the single member of the first V-shaped section passes between the two parallel members at least once.

3. The tent frame assembly of claim 2, wherein the single member passes between the two parallel members at least twice.

4. The tent frame assembly of claim 1, wherein each of the first and second hub comprise:

a first hub portion;

a second hub portion detachably connected to the first hub portion;

wherein in a connected configuration, the first hub portion and the second hub portion form a plurality of channels each configured to receive a respective frame member.

5. The tent frame assembly of claim 4, further comprising a first floor member, a second floor member, a third floor member, and a fourth floor member, wherein in the extended position the first floor member and the second floor member are expanded to be disposed approximately 180° away from each other, the third floor member and the fourth floor member are expanded to be disposed approximately 180° away from each other, and the first frame member, the second frame member, and the third frame member are expanded to be disposed between 30° and 60° away from each other.

6. The tent frame assembly of claim 5, wherein the plurality of channels comprise a first channel configured to receive the first frame member, a second channel configured to receive the second frame member, a third channel configured to receive the third frame member, and two floor channels each configured to receive a respective floor member.

7. The tent frame assembly of claim 6, further comprising:

a first support assembly comprising:

a first sliding member slideably coupled to the first end of the third frame member;

a first support strut comprising a first end and a second end, the first end pivotably coupled to the first sliding member and the second end pivotably coupled to the first floor member;

a second support strut comprising a first end and a second end, the first end pivotably coupled to the first sliding member and the second end pivotably coupled to the second floor member; and a first locking pin;

a second support assembly comprising:

a second sliding member slideably coupled to the second end of the third frame member;

a first support strut comprising a first end and a second end, the first end pivotably coupled to the second sliding member and the second end pivotably coupled to the third floor member; and a second support strut comprising a first end and a second end, the first end pivotably coupled to the second sliding member and the second end pivotably coupled to the fourth floor member; and a second locking pin.

8. The tent frame assembly of claim 7, wherein the first and second sliding members are configured to slide vertically to change the tent frame assembly between the collapsed position and the extended position.

9. The tent frame assembly of claim 7, wherein the first locking pin and the second locking pin are configured to selectively lock the tent frame assembly into the extended position.

10. The tent frame assembly of claim 7, wherein the first channel is configured to allow the first frame member to pivot between the collapsed position and the extended position, the second channel is configured to allow the second frame member to pivot between the collapsed position and the extended position, and the two floor channels are each configured to allow a respective floor member to pivot between the collapsed position and the extended position.

11. The tent frame assembly of claim 1, wherein the connecting section of the third frame member bisects the tent frame assembly when the tent frame assembly is in the extended position.

12. A tent frame assembly comprising:

a first hub;

a second hub, the second hub being separate and spaced apart from the first hub; and one or more collapsible frame members, each frame member having a first end and a second end, the first ends of the one or more collapsible frame members being coupled to the first hub, and the second ends of the one or more collapsible frame members being coupled to the second hub;

wherein the one or more collapsible frame members comprise a first frame member and a second frame member, wherein the first end and the second end of the first frame member and the second frame member are pivotably coupled to the first hub and second hub, respectively;

wherein the one or more collapsible frame members comprise a third frame member comprising a first end statically coupled to the first hub, a second end statically coupled to the second hub, and a connecting section;

wherein the connecting section bisects the tent frame assembly when the tent frame assembly is in an extended position, and wherein the connecting section comprises a first V-shaped section having a first apex oriented downwards and a second V-shaped section having a second apex oriented upwards.

13. The tent frame assembly of claim 12, wherein the second frame member is pivotable relative to the first and second hubs between the extended position in which the second frame member is spaced apart from the first frame member and the third frame member and a collapsed position in which the frame members are stacked adjacent to each other.

14. The tent frame assembly of claim 12, further comprising a first floor member, a second floor member, a third floor member, and a fourth floor member, wherein in the extended position the first floor member and the second floor member are expanded to be disposed approximately 180° away from each other, the third floor member and the fourth floor member are expanded to be disposed approximately 180° away from each other, and the first frame member, the second frame member, and the third frame member are expanded to be disposed between 30° and 60° away from each other.

15. The tent frame assembly of claim 14, further comprising:

a first support assembly comprising:

a first sliding member slideably coupled to the first end of the third frame member;

a first support strut comprising a first end and a second end, the first end pivotably coupled to the first sliding member and the second end pivotably coupled to the first floor member;

a second support strut comprising a first end and a second end, the first end pivotably coupled to the first sliding member and the second end pivotably coupled to the second floor member; and a first locking pin;

a second support assembly comprising:

a second sliding member slideably coupled to the second end of the third frame member;

a first support strut comprising a first end and a second end, the first end pivotably coupled to the second sliding member and the second end pivotably coupled to the third floor member; and a second support strut comprising a first end and a second end, the first end pivotably coupled to the second sliding member and the second end pivotably coupled to the fourth floor member; and a second locking pin;

wherein the first and second locking pin are configured to selectively lock the tent frame assembly into the extended position.

16. The tent frame assembly of claim 15, wherein the first and second sliding members are configured to slide vertically to position to change the tent frame assembly between the collapsed position and the extended position.

17. A tent frame assembly comprising:

a first hub;

a second hub, the second hub being separate and spaced apart from the first hub; and one or more collapsible frame members, each frame member having a first end and a second end, the first ends of the one or more collapsible frame members being coupled to the first hub, and the second ends of the one or more collapsible frame members being coupled to the second hub;

wherein the one or more collapsible frame members comprise a first frame member and a second frame member, wherein the first end and the second end of the first frame member and the second frame member are pivotably coupled to the first hub and second hub, respectively;

wherein the one or more collapsible frame members comprise a third frame member comprising a first end statically coupled to the first hub, a second end statically coupled to the second hub, and a connecting section;

wherein the connecting section bisects the tent frame assembly when the tent frame assembly is in an extended position, and wherein each of the first and second hub comprise:

a first hub portion;

a second hub portion detachably connected to the first hub portion;

wherein in a connected configuration, the first hub portion and the second hub portion form a plurality of channels each configured to receive a respective frame member.

18. The tent frame assembly of claim 17, wherein the plurality of channels comprise a first channel configured to receive the first frame member, a second channel configured to receive the second frame member, a third channel configured to receive the third frame member, and two floor channels each configured to receive a respective floor member.

19. The tent frame assembly of claim 18, wherein the first channel is configured to allow the first frame member to pivot between the collapsed position and the extended position, the second channel is configured to allow the second frame member to pivot between the collapsed position and the extended position, and the two floor channels are each configured to allow a respective floor member to pivot between the collapsed position and the extended position.

* * * * *